US009265386B2

(12) United States Patent
Granger

(10) Patent No.: US 9,265,386 B2
(45) Date of Patent: Feb. 23, 2016

(54) DEVICE FOR DISPENSING PRE-CUT WIPING MATERIALS

(76) Inventor: Maurice Granger, Saint Priest en Jarez (FR)

( * ) Notice: Subject to any disclaimer, the term of this patent is extended or adjusted under 35 U.S.C. 154(b) by 214 days.

(21) Appl. No.: 13/702,494

(22) PCT Filed: Jun. 7, 2011

(86) PCT No.: PCT/FR2011/051279

§ 371 (c)(1),
(2), (4) Date: Dec. 6, 2012

(87) PCT Pub. No.: WO2011/154648

PCT Pub. Date: Dec. 15, 2011

(65) Prior Publication Data

US 2013/0075417 A1 Mar. 28, 2013

(30) Foreign Application Priority Data

Jun. 8, 2010 (FR) ..... 10 54495

(51) Int. Cl.

| | |
|---|---|
| ***B26F 3/00*** | (2006.01) |
| ***B65H 35/00*** | (2006.01) |
| ***A47K 10/32*** | (2006.01) |
| ***A47K 10/42*** | (2006.01) |

(52) U.S. Cl.

CPC ..... *A47K 10/32* (2013.01); *A47K 10/424* (2013.01); *A47K 10/426* (2013.01); *A47K 2010/3233* (2013.01)

(58) Field of Classification Search

CPC ... A47K 10/32; A47K 10/424; A47K 10/426; A47K 2010/3233

USPC ..... 225/106; 242/596.8, 615.3, 598.5, 566; 221/45

See application file for complete search history.

(56) References Cited

U.S. PATENT DOCUMENTS

| | | | | |
|---|---|---|---|---|
| 1,122,673 | A * | 12/1914 | Winter et al. | 225/106 |
| 3,868,052 | A * | 2/1975 | Rockefeller | 225/106 |
| 4,289,262 | A * | 9/1981 | Finkelstein | 225/106 |
| 4,586,630 | A * | 5/1986 | Loder | 221/46 |
| 4,846,415 | A * | 7/1989 | Jernberg et al. | 242/419.4 |

(Continued)

FOREIGN PATENT DOCUMENTS

| | | |
|---|---|---|
| FR | 2 931 350 A1 | 11/2009 |
| GB | 1 516 097 A | 6/1978 |

(Continued)

OTHER PUBLICATIONS

International Search Report for International Application No. PCT/FR2011/051279, dated Sep. 14, 2011.

*Primary Examiner* — Ghassem Alie
*Assistant Examiner* — Bharat C Patel
(74) *Attorney, Agent, or Firm* — Heslin Rothenberg Farley & Mesiti P.C.

(57) ABSTRACT

This machine includes a flap and a cover having a plurality of opposite-facing pairs of matching shapes comprising grooves and ribs capable of interlocking with each other after the cover has been closed. A strip of material is unwound between the flap and the internal wall of the cover without lateral deformation and projects from the matching shapes. The shapes are directly designed or have an additional element for reducing the space between certain portions of ribs and grooves in order to allow and encourage the separation of a piece of strip of material when it is pulled by the user.

9 Claims, 9 Drawing Sheets

(56) References Cited

U.S. PATENT DOCUMENTS

| | | | | |
|---|---|---|---|---|
| 5,325,992 | A * | 7/1994 | Koller et al. | 221/63 |
| 5,335,811 | A * | 8/1994 | Morand | 221/45 |
| 5,566,873 | A * | 10/1996 | Guido | 225/106 |
| 5,727,721 | A * | 3/1998 | Guido et al. | 225/106 |
| 5,908,137 | A * | 6/1999 | Pattarozzi | 221/45 |
| 6,758,369 | B2 * | 7/2004 | Morin et al. | 221/48 |
| 6,817,484 | B2 * | 11/2004 | Morin et al. | 221/48 |
| 7,124,674 | B2 * | 10/2006 | Maxey | 83/649 |
| 7,134,572 | B2 * | 11/2006 | Morin | 221/48 |
| 7,530,460 | B2 * | 5/2009 | Lewis et al. | 206/409 |
| 8,672,255 | B2 * | 3/2014 | Granger | 242/596.8 |
| 2008/0110918 | A1 * | 5/2008 | Lee | 221/45 |

FOREIGN PATENT DOCUMENTS

| | | | |
|---|---|---|---|
| WO | 96/06556 | A1 | 3/1996 |
| WO | 2010/007259 | A1 | 1/2010 |

* cited by examiner

Fig. 3
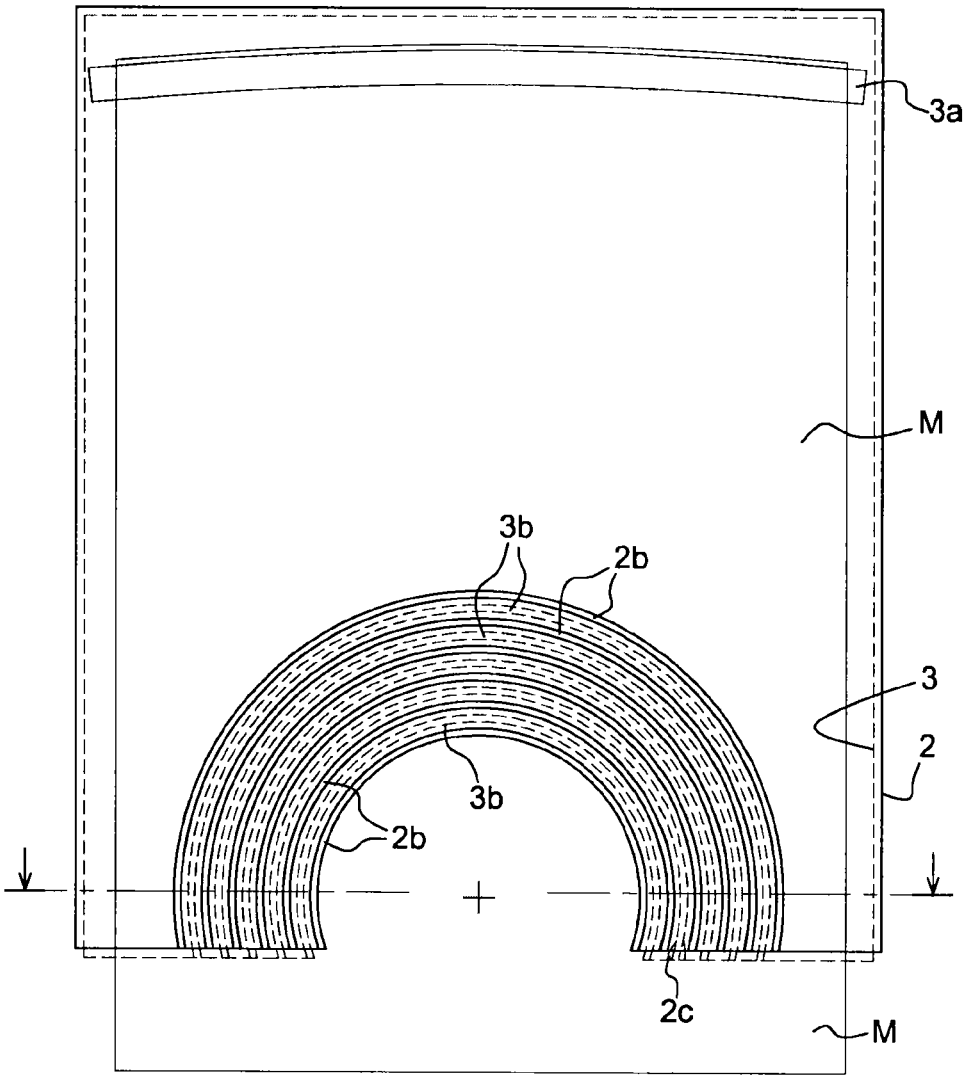
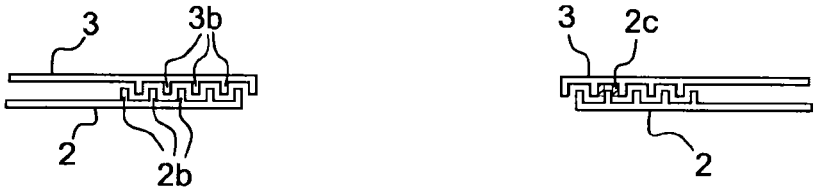
Fig. 4

DEVICE FOR DISPENSING PRE-CUT WIPING MATERIALS

CROSS REFERENCE TO RELATED APPLICATIONS

This application is a national stage filing under section 371 of International Application No. PCT/FR2011/051279, filed on Jun. 7, 2011, and published in French on Dec. 15, 2011, as WO 2011/154648 and claims priority of French application No. 1054495 filed on Jun. 8, 2010, the entire disclosure of these applications being hereby incorporated herein by reference.

BACKGROUND ART

The invention relates to the technical field of dispensing machines for wipe materials of the hand wipe, toilet paper, general-purpose wipe and similar type.

The Applicant has developed a machine for dispensing pre-cut wipe materials which is the subject of French Patent 2931350. As illustrated in FIG. 1, this machine (A) is of the type comprising a housing (1) forming a receptacle with a back plate, a lower horizontal wall and side walls with a front cover (2) articulated on a shaft (4). The front cover has a horseshoe shaped raised part (2*b*) on its inner face and a cut-out (2*a*) at its base. This machine also comprises a flap (3) which is articulated relative to the walls of the housing in the lower part of the housing, as disclosed in that patent. This flap is clip fastened relative to said walls so that it can be positioned in a vertical plane adjacent the inner face of the front cover. The upper part of the flap has an advantageously curved shape (6) and an outer face of the flap has a raised part (3*b*) with a curved configuration which is substantially semicircular that nests within the horseshoe shaped part (2*b*) when the front cover is closed leaving a passage (P) between parts (2*b*) and (3*b*) in order to allow delivery of the pre-cut wipe material.

The wipe material (M) in this embodiment is in the form of a pre-cut strip wound on a reel or it can be in pre-folded accordion pleated form.

According to the above-mentioned French Patent, in the lower part of the machine where the strip of material emerges, there are opposite-facing limit stops (5) either side of the strip of material which ensure separation of a piece of strip relative to the opposite-facing perforation line of the strip. The pulling force ensures, when the strip has completely passed between the front wall of the flap and the opposite facing face of the cover, separation of a piece of strip from the rest of the reel or the stack of accordion pleated material thanks to said limit stops. This patent states that the position of said limit stops is adjustable either side of the outlet opening for the strip of material and can be adjusted by appropriate sliding means.

The problem encountered is the fact that, when the strip of material emerges, the strip of material is crumpled because it is constricted as it passes between the limit stops. In principle, this is not objectionable at all because most users do not attach any importance to how the pre-cut strip of material is presented given the nature of its subsequent use as a hand wipe, general-purpose wipe, etc. which necessarily involves folding it.

Although the machine described in French patent 2931350 works very satisfactorily, the Applicant decided to optimise this machine still further in order to make it possible to dispense wipe material which, after cutting, is practically wrinkle free.

Dispensing machines which do not solve the above-mentioned problem are also known from Patents WO 2010/007259, GB 1516097 and WO 96/06556.

The solution devised by the Applicant achieves this objective perfectly and provides a machine for dispensing pre-cut wipe material which meets the various needs of different users.

BRIEF SUMMARY OF INVENTION

According to a first aspect of the invention, the wipe material dispensing machine of the type comprising a housing forming a receptacle with a back plate, a horizontal lower wall and side walls, a cover articulated on the housing and a flap articulated relative to the walls of the lower part of the housing, the raised parts of said flap and said cover having a substantially semicircular central passage to allow delivery of the pre-cut wipe material wound on a reel or in pre-folded accordion pleated form, is distinctive in that the flap and the cover have a plurality of opposite-facing pairs of matching shapes consisting of grooves and ribs capable of interlocking with each other after the cover has been closed, and in that the strip of material is capable of being unwound between the flap and the internal wall of the cover without lateral deformation and projecting from the matching male-female shapes consisting of ribs and grooves formed on the cover and the flap, and in that said shapes are directly designed or have additional means of reducing the space between certain portions of the ribs and grooves in order to allow and encourage separation of a piece of strip of material when it is pulled by the user.

These aspects and others will become apparent from the rest of the description.

BRIEF DESCRIPTION OF THE DRAWING FIGURES

The object of the present invention is described, merely by way of example, in the accompanying drawings in which:

FIG. 3 is a schematic front view showing the dispensing machine as configured in a first embodiment of the invention.

FIG. 4 is a partial front view showing meshing of the flap and the cover in the matching portions of the device according to the invention.

DETAILED DESCRIPTION

Figure 1:
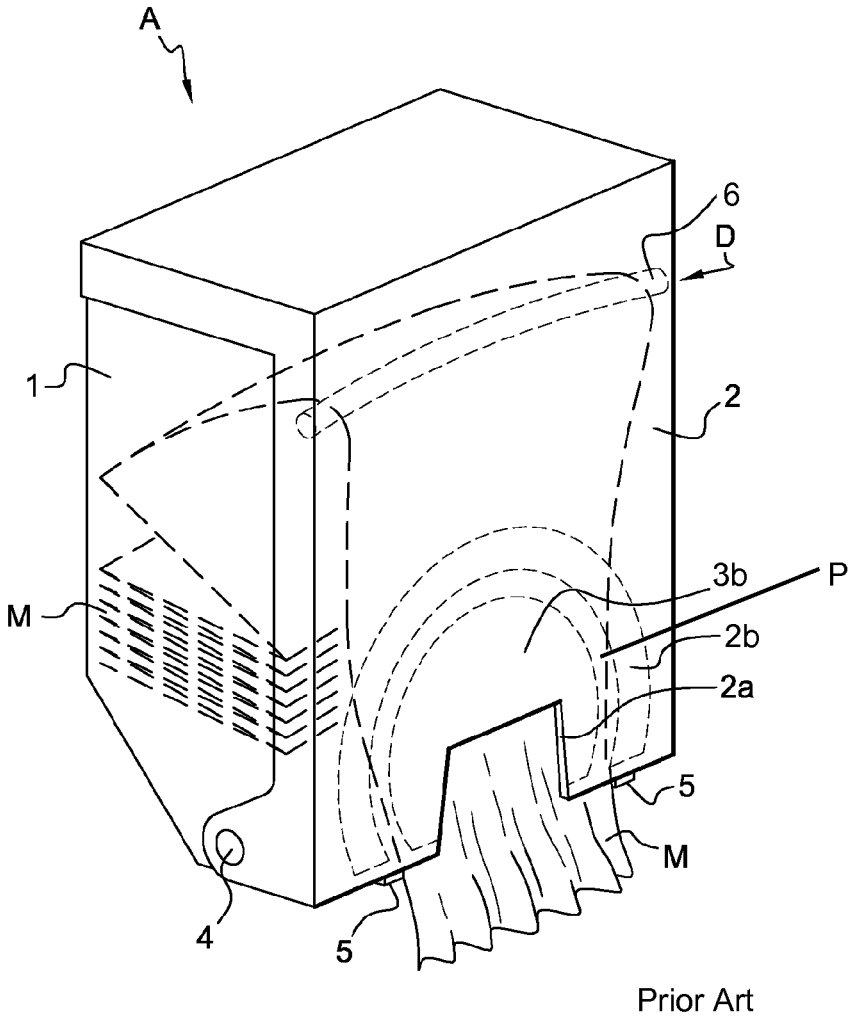
FIG. 1 is a ¾ perspective view of the wipe material dispensing machine according to the prior art described in French Patent No. 2931350.
Figure 2:
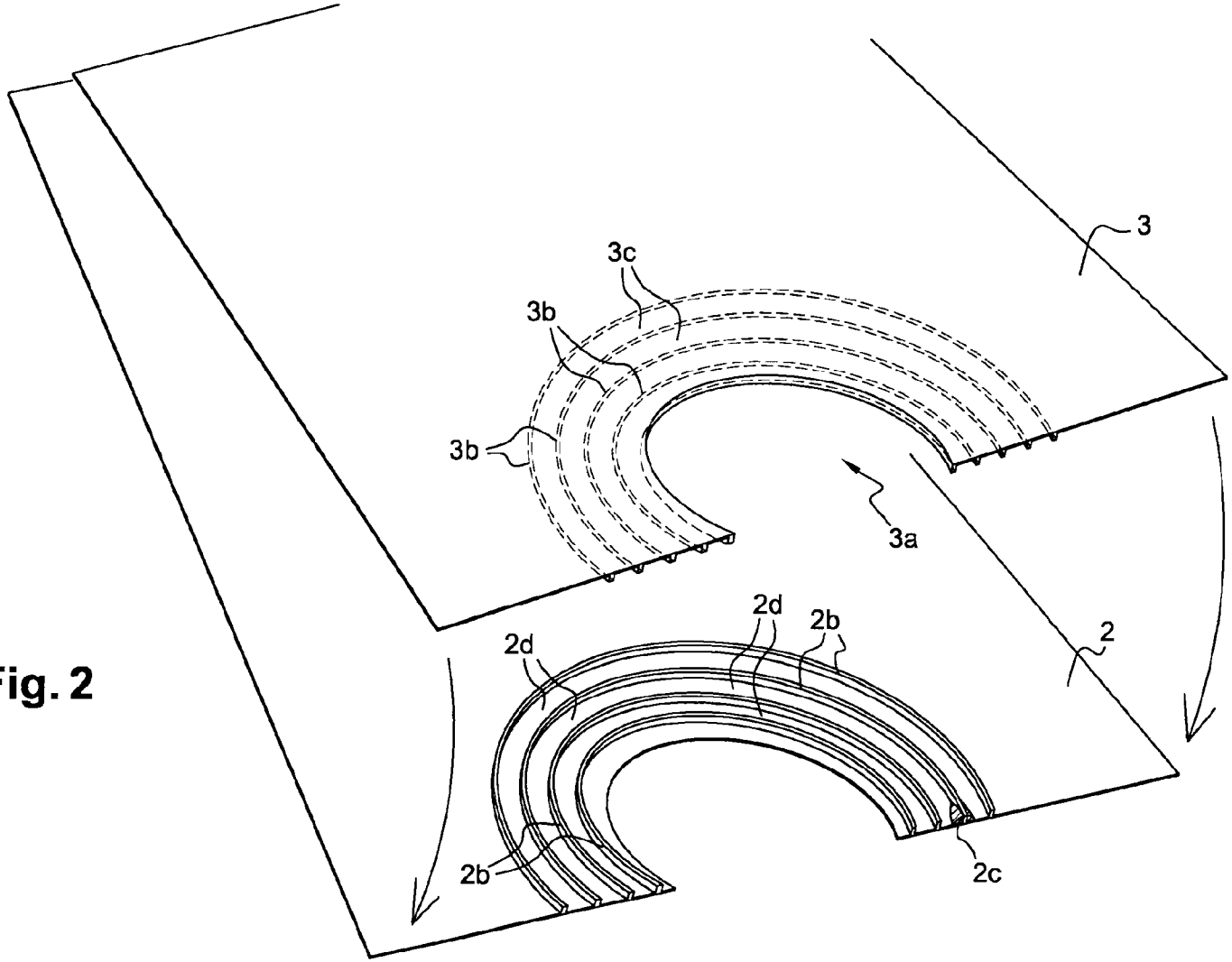
FIG. 2 is a schematic view that partially shows the flap and the cover of the dispensing machine arranged in a first embodiment of the device according to the invention.
Figure 5:
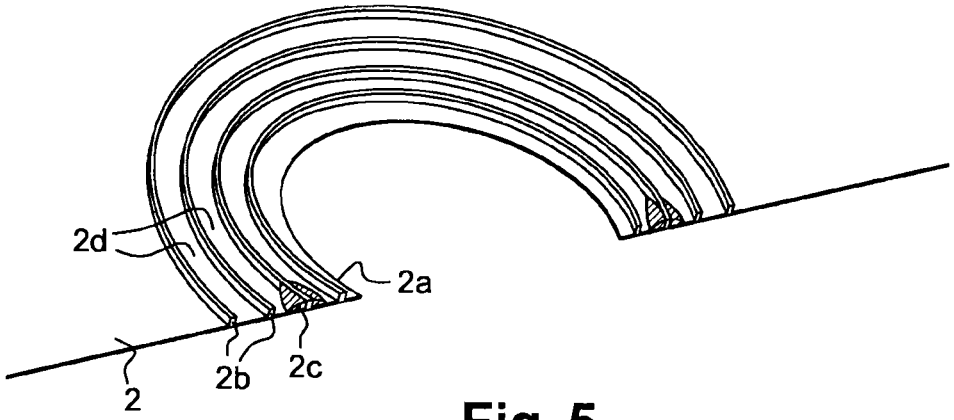
FIG. 5 is a partial perspective view showing the cover realised in accordance with the invention in a first embodiment.
Figure 6:
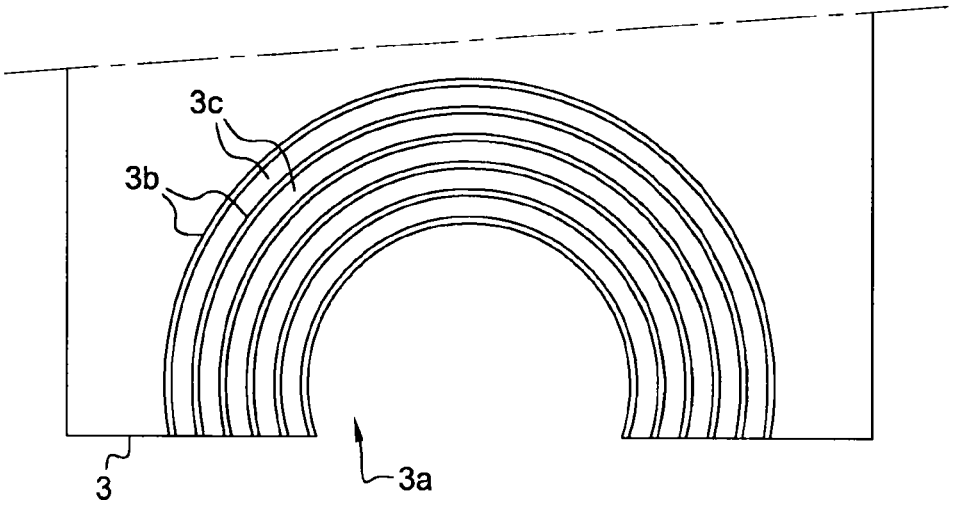
FIG. 6 is a view that complements FIG. 5 and shows the flap which is capable of fitting into the matching portions of the cover according to the invention.

In order that the object of the invention may more readily be understood, the following description is given, merely by way of example, reference being made to the accompanying drawings.

In order to allow the dispensing of a strip of material using a machine of the type described above and, in particular, in French Patent 2931350, the machine comprises a housing (1) with a cover (2) articulated on a shaft (4) and a flap (3) articulated on the side walls of the housing. The strip of material (M) in pre-cut or pre-folded accordion pleated form is capable of passing over and around the curved upper part (6) on the upper end of flap (3). The strip of material (M) thus passes in front of the flap and lies against the inner face of cover (2). The lower part of the cover has a central cut-out (2*a*) and the flap has a central cut-out (3*a*) through which the strip of material passes and is removed. Flap (3) and cover (2) have pairs of matching curved shapes (3*b*-3*c*) and (2*b*-2*d*) that are capable of partially interlocking during movement of the strip of material and, more specifically, portions (3*b*) and (2*b*) are ribs and portions (3*c*) and (2*d*) are grooves. In this embodiment, said matching shapes are curved.

In the context of the invention and in order to minimise crumpling of the material as it passes between the matching interlocking shapes, there is provision for the strip of material (M) to be unwound completely between flap (3) and the inner wall of cover (2), without lateral deformation and projecting either side of the matching male-female shapes consisting of pairs of grooves and ribs formed on the flap and the cover, as shown in FIG. 3, without there being any limit stops. These matching shapes that constitute grooves (2*d*-3*c*) and ribs (2*b*-3*b*) are numerous and create a rainbow-shaped configuration having an amplitude substantially greater than 180°. These shapes are formed directly or with an additional means of reducing the space between certain portions of the ribs and grooves in order to allow and facilitate separation of a piece of strip of material when it is pulled by the user.

In FIGS. 2 to 6, the various matching shapes have a configuration that makes them concentric relative to each other with an identical or different pitch, thus allowing regular interlocking. In this particular embodiment, the lower end of the flap or cover, i.e. either of them, is designed with an additional means consisting of tooth-shaped protrusions (2*c*) whose purpose is to make the gap between the grooves and ribs smaller when they interlock. This reduced space, as shown in the drawings, forms retention areas for the strip of material that encourage incipient tearing of the strip. These impressions or teeth are located at the lower end of the rainbow-shape obtained due to concentricity and make the material easier to separate when it is pulled.

The material passes between the matching groove-rib shapes without there being any deformation due to crumpling of the strip of material. In the context of this implementation, it is also possible to design, on the cover and on the flap, several alternating tooth-shaped imprints in order to encourage separation of a strip of material.

The above-mentioned shapes in this first embodiment are obtained directly by moulding.

Figure 7:
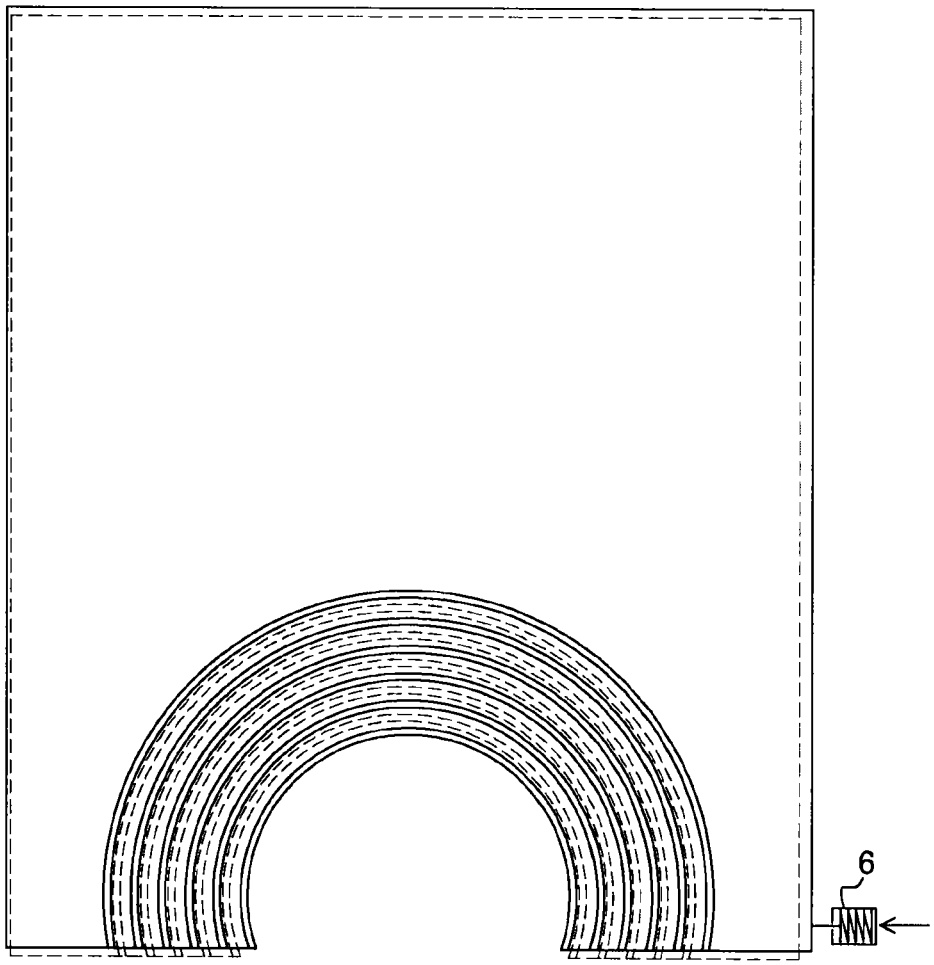
FIG. 7 is a schematic view showing an alternative second embodiment of the device.

FIG. 7 shows a second embodiment of the invention. In this case, the matching shapes of the above-mentioned type consist of sets of grooves and ribs that are still concentric relative to each other after interlocking, which corresponds to closing of the cover. In this embodiment, there is provision to use a means of pushing (6) capable of elastic deformation in order to exert lateral thrust on the flap itself relative to the cover. This means of pushing can, for example, be provided in the form of a spring element located on one side of the housing of the machine This means is capable of pushing the flap sideways in order to allow, over at least half of the assembly, displacement of the flap relative to the cover thereby enabling the grooves formed on the flap to move closer to the ribs formed on the cover. This reduces the space between the grooves and the ribs and this has the effect of making the strip of material easier to separate when it is pulled by the user. The strip of material therefore passes through a very constricted space as a result of the ribs and grooves moving closer together and this makes it easier to separate a piece of material.

Figure 8:
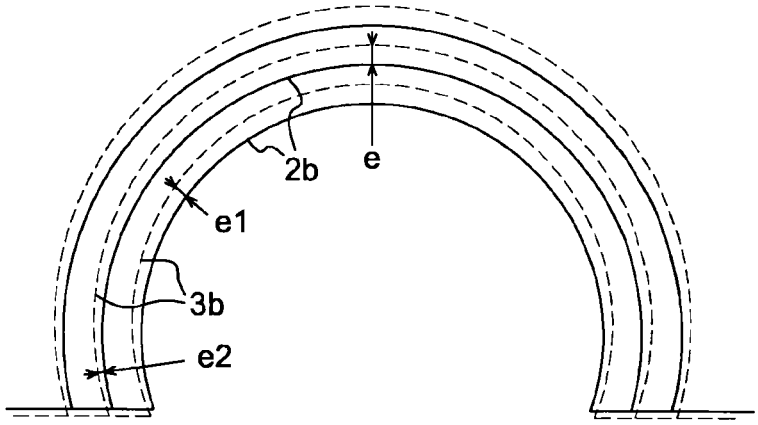
FIG. 8 is a top view of the cover in a third alternative embodiment.
Figure 9:
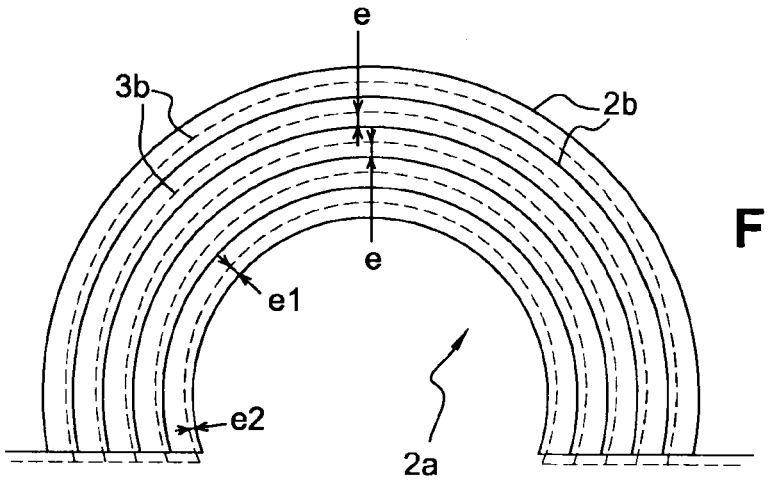
FIG. 9 is a view that complements FIG. 8 and shows a large number of the various grooves and ribs formed non-concentrically on the cover and on the flap in the context of the third alternative embodiment.

FIGS. 8 and 9 show another version of the device according to the invention that makes it possible to optimise manufacture of the dispensing machine without requiring any additional part. To achieve this, and as shown in the drawings, the sets of grooves and ribs formed on the cover are not concentric with the sets of grooves and ribs provided on the flap. They are off-centred to a certain extent and this modifies and reduces the space through which the strip of material passes. Thus, in the drawings, the space (e) between the grooves and ribs is not regular and varies. In its middle part, the space (e) between the rib formed on the cover and the adjacent ribs formed on the flap is regular. It is around 5 mm for example. In contrast, in its lower part, the ribs formed on the cover are closer to the ribs formed on the flap with a reduced space (e2) which can be approximately 0.50 to 1 mm. An intermediate location (e1) between (e) and (e2) is also shown. The essential function of this constriction is to facilitate separation of the strip of material.

This latter optimised version is realised when moulding the cover and the flap and ensures that the described matching shapes on the flap and on the cover interlock perfectly. In this embodiment, no additional parts are added and the material is cut naturally with virtually no crumpling. If there is any crumpling it is relatively inconspicuous and quickly eliminated by the strip of material returning to its natural shape.

Figure 10:
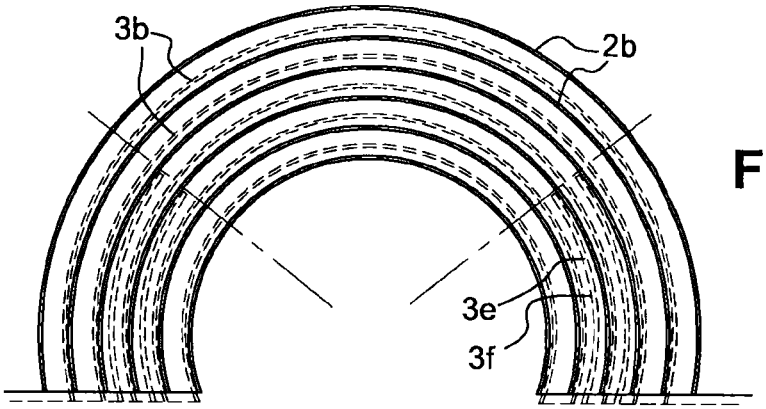
FIG. 10 is a schematic view showing an alternative embodiment.

FIG. 10 shows another version in which slits (30 are formed in the end parts of the grooves provided on flap (3). These slits made in the central part of the grooves define tabs (3*e*) that allow a certain degree of elastic deformation. Any pressure exerted by the cover on the flap can cause elastic deformation of said tabs (3*e*) which makes it possible to facilitate separation of a piece of strip of material of a given size. Slits (30 are formed over an angular amplitude of approximately 60° on each side of the flap in the area where the groove-rib portions have a concentric configuration.

Figure 11:
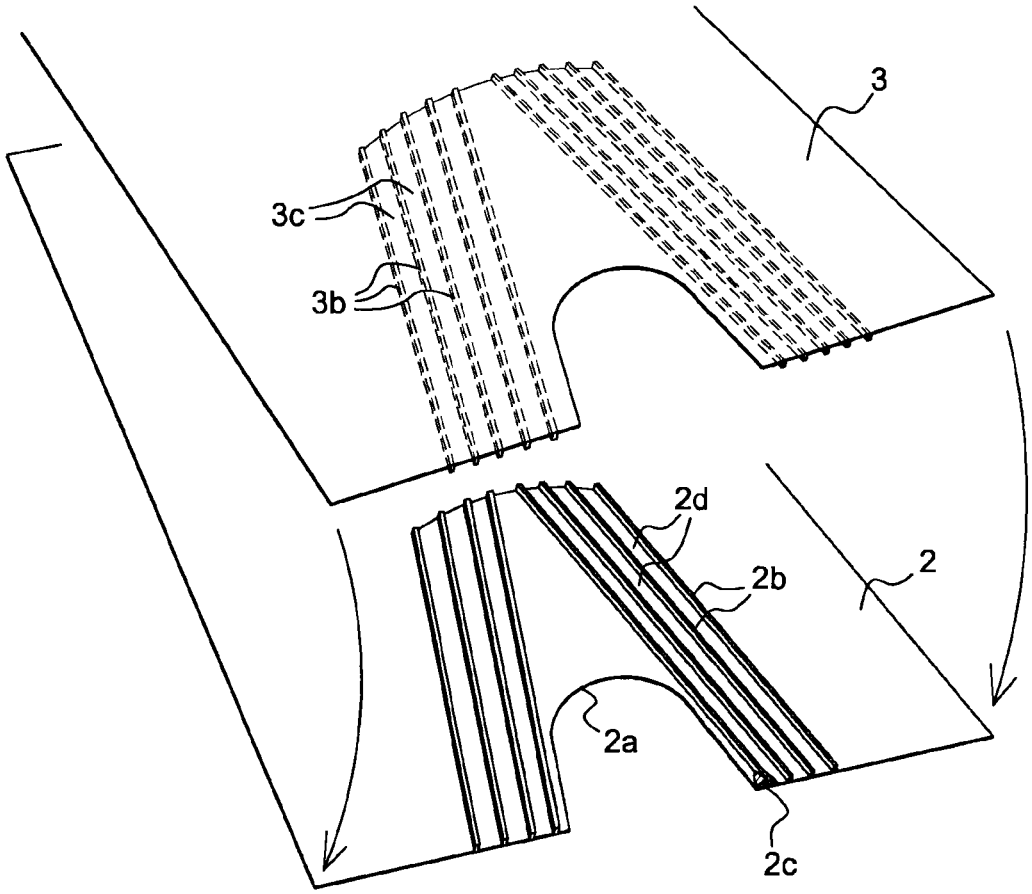
FIGS. 11 and 12 are schematic views showing other configurations of the invention with the pairs of ribs and grooves formed on the flap and the cover not being concentric.
Figure 12:
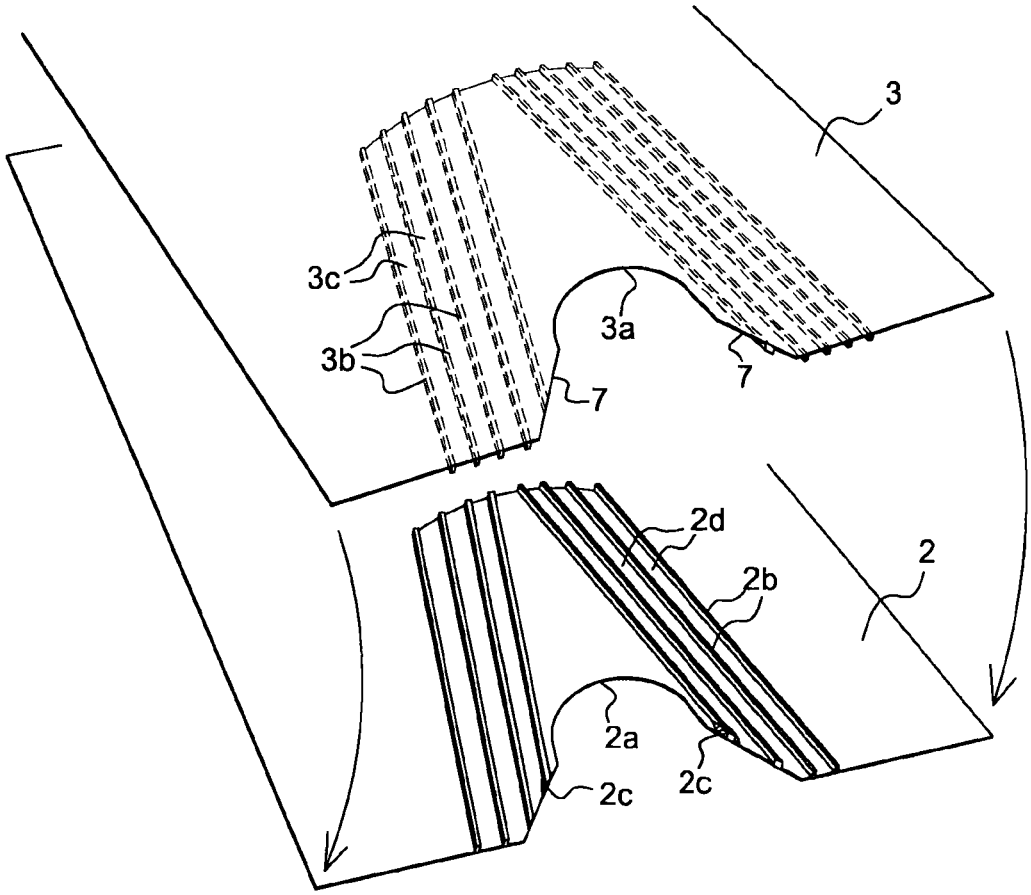

Other configurations of the pairs of ribs-grooves according to the invention are shown in FIGS. 11 and 12.

In FIG. 11, flap (3) and cover (2) have pairs of matching shapes (3*b*-3*c*) and (2*b*-2*d*) capable of partially interlocking during movement of the strip of material and they have a non-curved configuration. As shown, these matching shapes are arranged obliquely either side of the central opening and slant towards each other, thus producing a taper effect.

Also, and as previously, the lower end of the flap or cover is designed with an additional means consisting of tooth-shaped protrusions (2*c*) whose purpose is to make the gap between the grooves and ribs smaller when they interlock.

In FIG. 11 the ribs and grooves extend as far as the transverse edge of the cover and the flap.

FIG. 12 shows pairs of ribs and grooves on flap (3) and cover (2) with the same layout, but with a slanting cut-out (7) that produces a bevel effect that affects at least two or three pairs of ribs and grooves either side of the central opening through which the strip of material passes. Protruding teeth (2*c*) are located in its pairs of grooves-ribs and these are therefore set at a greater height and allow gradual cutting of the strip of material.

Figure 13:
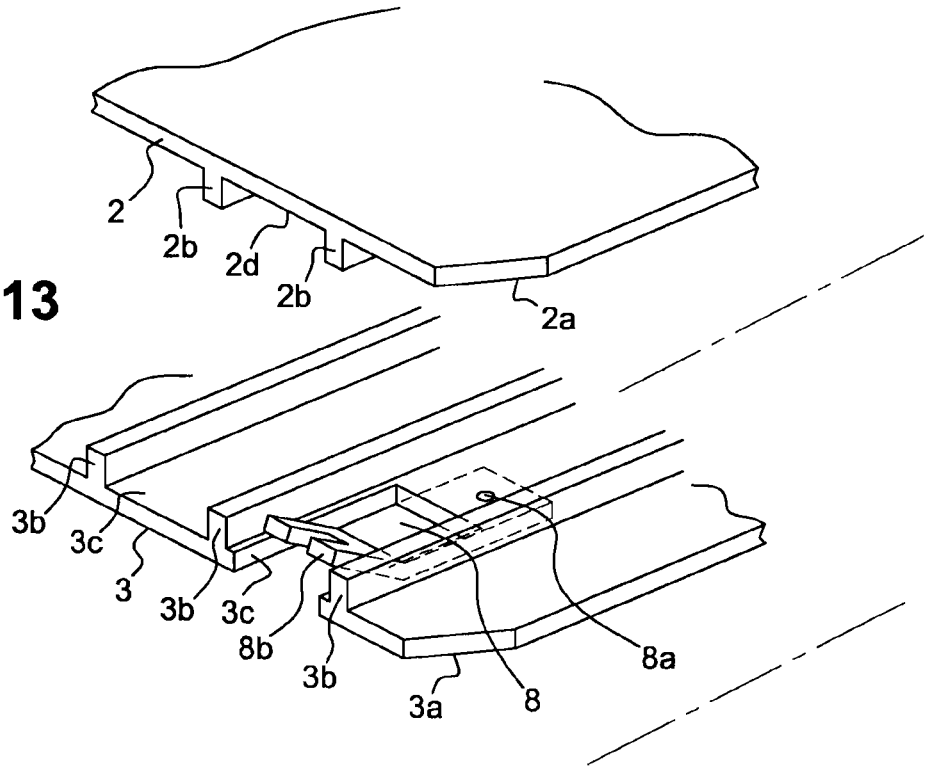
FIGS. 13 and 14 are schematic half-views of another version of the invention in which the flap is designed with at least one U-shaped element that is positioned in one of the grooves of the flap and sits astride an opposite-facing rib on the cover.
Figure 14:
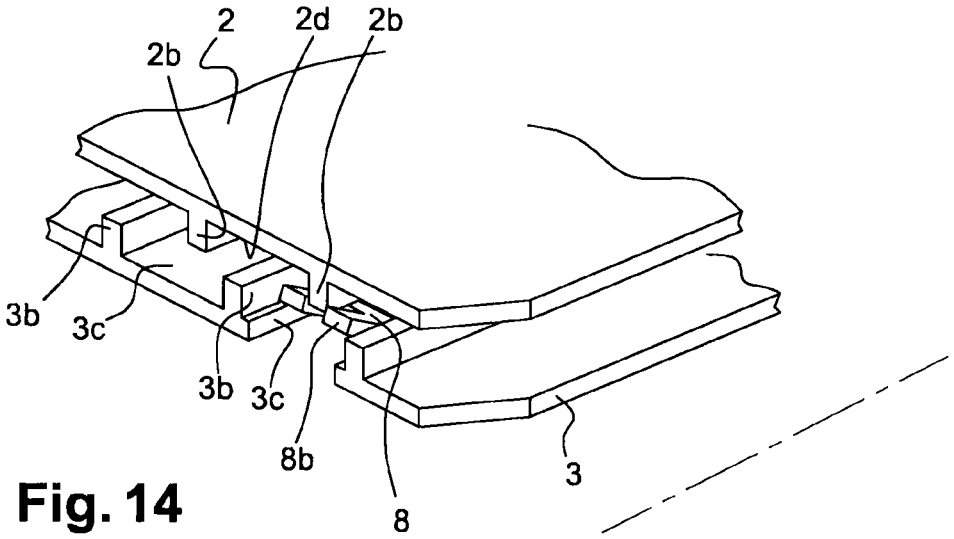

FIGS. 13 and 14 show another version of this configuration with pairs of ribs and protrusions formed on flap (3) and on cover (2). FIG. 13 is a view before the cover is closed on the flap and FIG. 14 is a view after the cover is closed on the flap.

In this embodiment, there are pairs of grooves-ribs (3*b*-3*c*) (2*b*-2*d*) on the flap and on the cover but there is also at least one flexible tab (8) which has one of its ends (8*a*) located and attached to the wall of the flap and its other end has a fork shape (8*b*) intended to fit around one of the ribs (2*b*) provided on the cover. This tab therefore fits in the space defined by a groove, the end of which is cut off in order to provide room for the fork-shaped part of the tab. As shown in FIG. 14, the fork shape (8*b*) fits around groove (2*b*) and leaves room for the pulled strip of material to pass. Such an arrangement can be located either side of the central opening through which the strip of material passes along the axis of symmetry shown in the drawings. The central opening (2*a*-3*a*) formed on the cover and on the flap may have the configurations shown for the various versions. In this embodiment, one exploits the elasticity of tab (8) in order to facilitate cutting of the strip of material. This particular embodiment is particularly specific to non-woven, pre-cut wipe materials.

Embodiments with the various above-mentioned pairs of grooves-ribs can be realised with regular or irregular pitches but always with the same depth.

The advantages of the invention are readily apparent. The improved visual appearance of the strip of material that is cut or separated from the reel or folded in the case of an accordion pleated material is emphasised.

The invention claimed is:

1. A wipe material dispensing machine comprising a housing forming a receptacle, a cover articulated on the housing, and a flap extending along a front of the receptacle adjacent and interior of the cover when the cover is closed, lower parts of said flap and said cover having a respective central cut-out to allow delivery of pre-cut wipe material wound on a reel or in pre-folded accordion pleated form from the receptacle, wherein the flap and the cover have a plurality of opposite-facing pairs of offset matching shapes comprising a first series of alternating grooves and ribs provided on the flap and extending about the central cut-out of the flap, and a second series of alternating grooves and ribs provided on the cover and extending about the central cut-out of the cover, the first and the second series interlocking after the cover has been closed such that each rib of the first series is positioned in a groove of the second series laterally adjacent a rib of the second series, and a strip of the material is unwound between the flap and an inner wall of the cover without lateral deformation and projects from an exit end of the offset matching shapes, and further including means for reducing a gap adjacent the exit end between exit end portions of adjacent ribs of the interlocking first and second series, compared to a gap between remaining portions of the adjacent ribs, in order to allow and encourage separation of a piece of the strip of material when the piece is pulled by a user, and wherein the alternating grooves and ribs of each series circumscribe the respective central cut-out, and the interlocking first and second series of alternating grooves and ribs has an overall rainbow-shaped configuration.

2. The wipe material dispensing machine as claimed in claim 1, wherein the means for reducing a gap adjacent the exit end comprises a tooth-shaped protrusion that constricts the gap between the exit end portions of the adjacent ribs, and wherein the alternating grooves and ribs of the interlocking first and second series are concentric relative to each other.

3. The wipe material dispensing machine as claimed in claim 1, wherein the means for reducing a gap adjacent the exit end comprises a means for pushing capable of elastic deformation located on the housing and allowing relative displacement of the flap relative to the cover thereby enabling the exit end portions of the adjacent ribs to move closer together, and wherein the alternating grooves and ribs of the first and second series are concentric relative to each other.

4. The wipe material dispensing machine as claimed in claim 1, wherein the second series of alternating grooves and ribs is not concentric with the first series of alternating grooves and ribs, and the gap between the adjacent ribs of the interlocking first and second series varies, and is reduced adjacent the exit end.

5. The wipe material dispensing machine as claimed in claim 4, wherein, in a middle part, the gap between the adjacent ribs is regular and approximately 5 mm, and at the exit end, the reduced gap is approximately 0.5 to 1 mm.

6. The wipe material dispensing machine as claimed in claim 4, wherein slits are provided in end parts of the grooves provided on the flap, and the slits define tabs that allow a certain degree of elastic deformation.

7. The wipe material dispensing machine as claimed in claim 6, wherein angular amplitude over which the slits are formed is 60° on either side of the central cut-out of the flap in an area where the alternating grooves and ribs have a concentric configuration.

8. The wipe material dispensing machine as claimed in claim 1, further comprising at least one flexible tab having one end located and attached to a wall of the flap and an other end having a fork shape that fits around one of the ribs provided on the cover, and said tab is located in a space defined by a groove, an end of the groove being cut to allow movement of the fork shaped end.

9. A wipe material dispensing machine comprising a housing forming a receptacle, a cover articulated on the housing, and a flap extending along a front of the receptacle adjacent and interior of the cover when the cover is closed, lower parts of said flap and said cover having a respective central cut-out to allow delivery of pre-cut wipe material wound on a reel or in pre-folded accordion pleated form from the receptacle, wherein the flap and the cover have a plurality of opposite-facing pairs of offset matching shapes comprising a first series of alternating grooves and ribs circumscribing the central cut-out of the flap and a second series of alternating grooves and ribs circumscribing the central cut-out of the cover, the first and the second series interlocking after the cover has been closed such that each rib of the first series is positioned in a groove of the second series laterally adjacent a rib of the second series, and a strip of the material is unwound between the flap and an inner wall of the cover without lateral deformation and projects from an exit end of the offset matching shapes, and wherein the interlocking first and second series of alternating grooves and ribs has an overall rainbow-shaped configuration.

* * * * *